US010256524B2

(12) United States Patent
Murata et al.

(10) Patent No.: US 10,256,524 B2
(45) Date of Patent: Apr. 9, 2019

(54) ANTENNA SUBSTRATE

(71) Applicant: Panasonic Corporation, Osaka (JP)

(72) Inventors: Tomohiro Murata, Kanagawa (JP); Junji Sato, Tokyo (JP)

(73) Assignee: Panasonic Corporation, Osaka (JP)

( * ) Notice: Subject to any disclaimer, the term of this patent is extended or adjusted under 35 U.S.C. 154(b) by 283 days.

(21) Appl. No.: 15/435,157

(22) Filed: Feb. 16, 2017

(65) Prior Publication Data

US 2017/0250457 A1 Aug. 31, 2017

(30) Foreign Application Priority Data

Feb. 29, 2016 (JP) ..... 2016-038032

(51) Int. Cl.

| | |
|---|---|
| ***H01Q 1/22*** | (2006.01) |
| ***H01Q 21/28*** | (2006.01) |
| ***H01Q 1/48*** | (2006.01) |
| ***H01Q 9/06*** | (2006.01) |
| ***H01Q 21/00*** | (2006.01) |

(52) U.S. Cl.

CPC ..... *H01Q 1/2283* (2013.01); *H01Q 1/48* (2013.01); *H01Q 9/065* (2013.01); *H01Q 21/00* (2013.01); *H01Q 21/28* (2013.01)

(58) Field of Classification Search

CPC ..... H01Q 21/28; H01Q 1/2283; H01Q 21/00; H01Q 9/065; H01Q 1/48

See application file for complete search history.

(56) References Cited

U.S. PATENT DOCUMENTS 3,747,114 A * 7/1973 Shyhalla ..... H01Q 21/062 333/238
3,921,177 A * 11/1975 Munson ..... H01Q 9/0435 333/238
4,291,312 A * 9/1981 Kaloi ..... H01Q 1/48 343/700 MS
2011/0121913 A1 5/2011 Satou et al.

(Continued)

FOREIGN PATENT DOCUMENTS

JP 2008-283381 A 11/2008
JP 2014-085317 A 5/2014
WO 2010/007782 A1 1/2010

*Primary Examiner* — Graham P Smith
*Assistant Examiner* — Jae K Kim
(74) *Attorney, Agent, or Firm* — Seed IP Law Group LLP

(57) ABSTRACT

An antenna substrate, provided with: a substrate, a ground electrode, a first antenna element, a second antenna element, a first transmission line and a second transmission line. The first antenna element that is arranged at a first distance away from the ground electrode, on the substrate within the first opening area. The second antenna element that is arranged at a second distance away from the ground electrode, on the substrate within the second opening area. The first distance is a shortest distance between the ground electrode and the first antenna element in a direction along a plane along which an electric field among an electromagnetic wave radiated from the first antenna element vibrates. The second distance is a shortest distance between the ground electrode and the second antenna element in a direction along a plane along which an electric field among an electromagnetic wave radiated from the second antenna element vibrates. The first distance is different from the second distance.

10 Claims, 6 Drawing Sheets

(56) References Cited

U.S. PATENT DOCUMENTS

| | | | | |
|---|---|---|---|---|
| 2014/0253408 | A1* | 9/2014 | Kikin | G06K 7/10356 343/893 |
| 2015/0070228 | A1* | 3/2015 | Gu | H01Q 1/2283 343/727 |
| 2015/0236421 | A1* | 8/2015 | Zemliakov | H01Q 9/045 343/700 MS |

* cited by examiner

ANTENNA SUBSTRATE

BACKGROUND

1. Technical Field

The present disclosure relates to an antenna substrate that is used in a multiple-input multiple-output (MIMO) transmission/reception module.

2. Description of the Related Art

In the field of wireless communication, the multiple-input multiple-output (MIMO) method with which transmission and reception are performed using a plurality of transmission antennas and a plurality of reception antennas is known as a method that improves communication speed and reliability. In radar systems also, it is possible to dramatically improve the target detection performance of radar by employing the MIMO method.

In the MIMO method, an antenna having M number of transmission antenna elements and N number of reception antenna elements is treated as a virtual array antenna that is provided with M×N number of antenna elements. However, in this case, the antenna gain of the individual antenna elements is required to be equal. This is because, in a radar system or communication system of the MIMO method, in the case where there are differences in antenna gain among the plurality of antenna elements, the sidelobe signal level increases in received signals and the carrier-to-noise ratio (CN ratio) increases.

Japanese Unexamined Patent Application Publication No. 2014-85317 discloses a technique with which, in a MIMO radar system, the CN ratio of received signals is improved by varying all of the arrangement intervals of a plurality of transmission antenna elements, for example.

In this connection, in a radar system or communication system of the MIMO method in which radio waves of a millimeter wave band are used, the sizes of the antenna elements can be reduced to the wavelength order. Hence, there have been advances in the development of transmission/reception modules in which a semiconductor chip for signal control is mounted on an antenna substrate on which a plurality of antenna elements are arranged corresponding with the MIMO method. In a transmission/reception module such as this, the antenna gain of the individual antenna elements is required to be equal.

An antenna substrate on which a plurality of antenna elements are arranged corresponding with the MIMO method is designed taking into account the number of antenna elements and redundancy. There is a small degree of freedom in the arrangement of the plurality of antenna elements and the arrangement of a plurality of transmission lines connecting each of the antenna elements and each of terminal sections of the semiconductor chip. Therefore, the individual transmission lines are not equal in length. As a result, the antenna gain of the individual antenna elements based upon the terminal sections of the semiconductor chip is not equal, and therefore differences occur in antenna gain among the plurality of antenna elements. Conventionally, in order to eliminate differences in antenna gain, calibrations with respect to signals that are transmitted and received are carried out in signal processing.

SUMMARY

However, in order to eliminate differences in antenna gain, complex calibrations are required in the signal processing, and therefore the signal processing load increases.

One non-limiting and exemplary embodiment facilitates providing an antenna substrate with which it is possible to equalize the antenna gain of individual antenna elements based upon the terminal sections of a semiconductor chip, and to eliminate differences in antenna gain among the plurality of antenna elements, without increasing the signal processing load.

In one general aspect, the techniques disclosed here feature an antenna substrate that is provided with: a substrate on which a semiconductor chip having a first terminal and a second terminal are mounted; a ground electrode that is arranged on the substrate and has a first opening area and a second opening area; a first antenna element that is arranged at a first distance away from the ground electrode, on the substrate within the first opening area; a second antenna element that is arranged at a second distance away from the ground electrode, on the substrate within the second opening area; a first transmission line that connects the first terminal and the first antenna element; and a second transmission line that connects the second terminal and the second antenna element, in which the first distance is a shortest distance between the ground electrode and the first antenna element in a direction along a plane along which an electric field among an electromagnetic wave radiated from the first antenna element vibrates, the second distance is a shortest distance between the ground electrode and the second antenna element in a direction along a plane along which an electric field among an electromagnetic wave radiated from the second antenna element vibrates, and the first distance is different from the second distance.

According to the present disclosure, it is possible to equalize the antenna gain of individual antenna elements based upon a chip terminal section, and to eliminate differences in antenna gain among the plurality of antenna elements, without increasing the signal processing load.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

First, the circumstances that led to the present disclosure will be described. The present disclosure relates to an antenna substrate that is used in a multiple-input multiple-output (MIMO) transmission/reception module.

As previously mentioned, in a radar system or communication system of the MIMO method in which radio waves of a millimeter wave band are used, there have been advances in the development of transmission/reception modules in which a semiconductor chip for signal control is mounted on an antenna substrate on which a plurality of antenna elements are arranged corresponding with the MIMO method.

Figure 1:
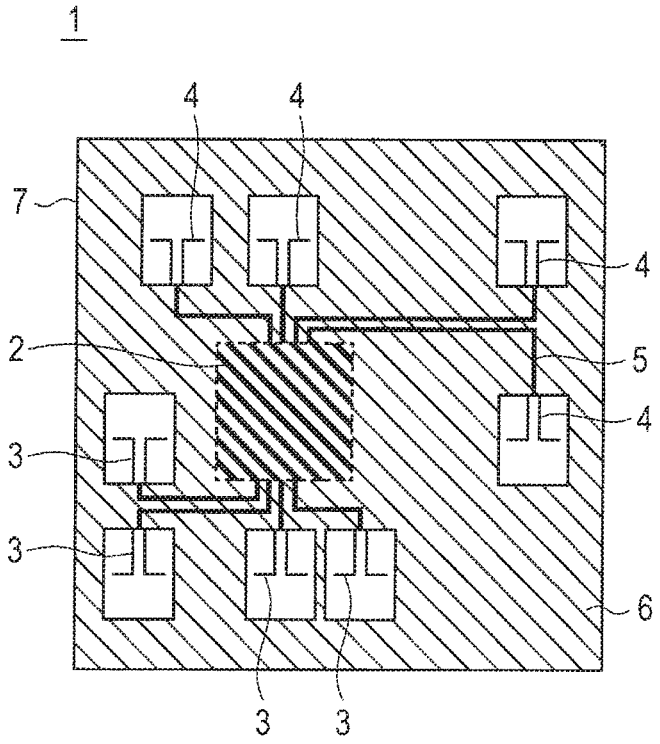
FIG. 1 depicts a conventional antenna substrate.

FIG. 1 is a drawing depicting a conventional antenna substrate 1. The antenna substrate 1 is used in a transmission/reception module. The transmission/reception module includes the antenna substrate 1 and a semiconductor chip 2 that is mounted on the antenna substrate 1. The antenna substrate 1 includes a plurality of antenna elements that include a plurality of transmission antenna elements 3 and a plurality of reception antenna elements 4, transmission lines 5, a ground electrode 6, and a substrate 7.

The plurality of transmission antenna elements 3 and the plurality of reception antenna elements 4 are arranged on the substrate 7 and are electrically connected to terminal sections of the semiconductor chip 2 by the plurality of transmission lines 5. The ground electrode 6 is formed on the substrate 7 and includes a plurality of opening areas that enclose each of the plurality of transmission antenna elements 3 and each of the plurality of reception antenna elements 4.

In the antenna substrate 1 such as that depicted in FIG. 1, antenna gain in the antenna elements 3 and 4 based upon the terminal sections of the semiconductor chip 2 is required to be equalized in each of the plurality of transmission antenna elements 3 and each of the plurality of reception antenna elements 4. Antenna gain in the antenna elements 3 and 4 based upon the terminal sections of the semiconductor chip 2 is obtained by subtracting the loss in antenna gain caused by the transmission lines 5 connecting the antenna elements 3 and 4 and the terminal sections of the semiconductor chip 2, from the antenna gain of the antenna elements 3 and 4 themselves.

However, the antenna substrate 1 is designed taking into account the number of the antenna elements 3 and 4 and redundancy, and therefore there is a small degree of freedom in the arrangement of the plurality of antenna elements 3 and 4 and the arrangement of the plurality of transmission lines 5 connecting the antenna elements 3 and 4 and the terminal sections of the semiconductor chip 2. Therefore, it is difficult to equalize all of the lengths of the plurality of transmission lines 5 connecting each of the antenna elements 3 and 4 and each of the terminal sections of the semiconductor chip 2. For example, in FIG. 1, the transmission lines 5 connecting the antenna elements 3 and 4 and the terminal sections of the semiconductor chip 2 become longer as the arrangement positions of the antenna elements 3 and 4 become further away from the semiconductor chip 2.

The loss in antenna gain caused by wiring (wiring loss) increases as the transmission lines 5 become longer. Therefore, antenna gain based upon the terminal sections of the semiconductor chip 2, in the antenna elements 3 and 4 arranged far away from the semiconductor chip 2 decreases by an amount proportionate to the wiring loss. Therefore, even when the shapes of the antenna elements 3 and 4 are identical and the antenna gain of the antenna elements 3 and 4 themselves is equalized, the lengths of the transmission lines 5 are different for each antenna element. Therefore, differences in antenna gain occur among the plurality of antenna elements.

In light of circumstances such as these, the present disclosure provides an antenna substrate with which with which it is possible to equalize the antenna gain of individual antenna elements based upon the terminal sections of a semiconductor chip, and to eliminate differences in antenna gain among the plurality of antenna elements, even when the lengths of transmission lines are different from each other.

Next, embodiments of the present disclosure will be described in detail with reference to the drawings. It should be noted that the embodiments described hereinafter are examples, and the present disclosure is not restricted by these embodiments.

Embodiment 1

Figure 2A:
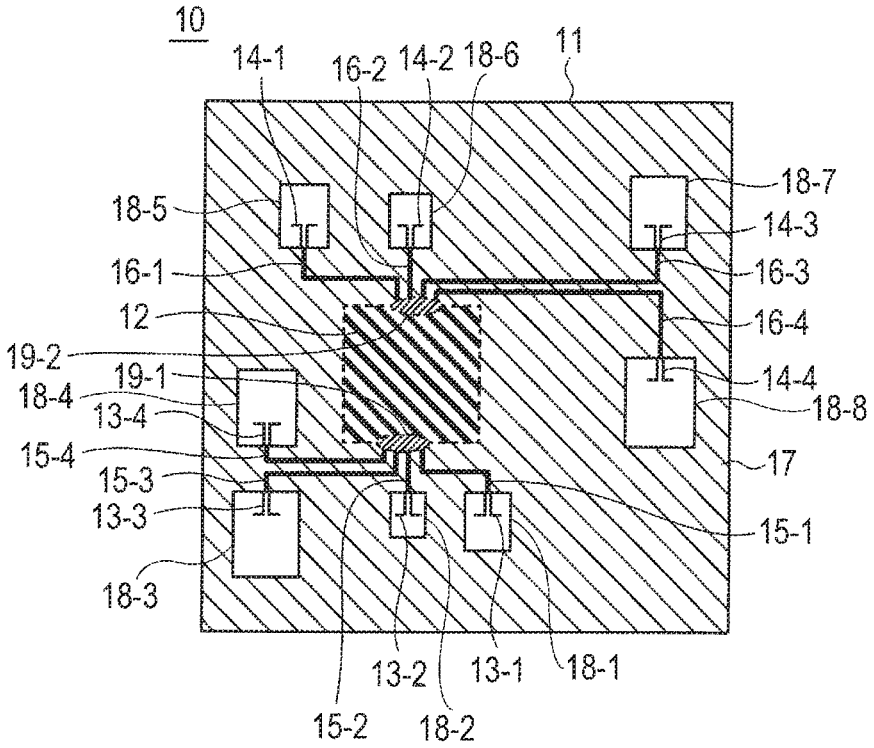
FIG. 2A depicts an antenna substrate according to embodiment 1 of the present disclosure.
Figure 2B:
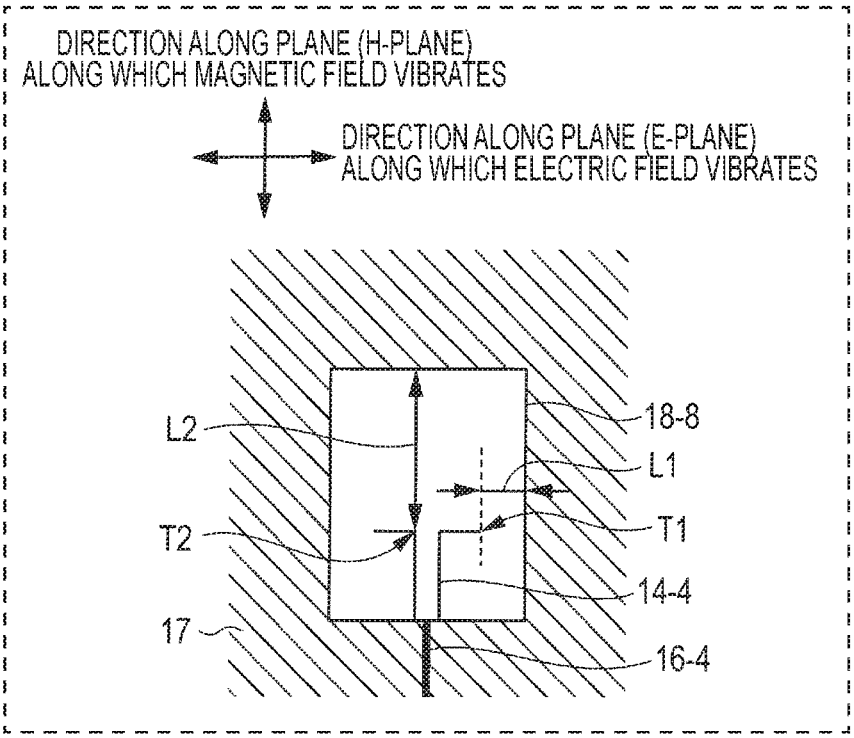
FIG. 2B depicts an enlarged view of the periphery of an antenna element on the antenna substrate according to embodiment 1 of the present disclosure.

FIG. 2A is a drawing depicting an antenna substrate 10 according to embodiment 1 of the present disclosure. FIG. 2B is an enlarged view of the periphery of an antenna element on the antenna substrate 10 according to embodiment 1 of the present disclosure. It should be noted that FIG. 2A also depicts a semiconductor chip 12 that is mounted on the antenna substrate 10. Furthermore, FIG. 2A is a top view of the antenna substrate 10.

The antenna substrate 10 has a substrate 11, a plurality of antenna elements that include transmission antenna elements 13-1 to 13-4 and reception antenna elements 14-1 to 14-4, transmission lines 15-1 to 15-4, transmission lines 16-1 16-4, and a ground electrode 17.

The semiconductor chip 12 has a ball grid array (BGA) structure, for example. The semiconductor chip 12 is provided with terminal sections 19-1 and 19-2. The terminal sections 19-1 and 19-2 each have a plurality of terminals.

The transmission antenna elements 13-1 to 13-4 and the reception antenna elements 14-1 to 14-4 are arranged on the substrate 11. Each of the transmission antenna elements 13-1 to 13-4 is electrically connected to the terminal section 19-1 by means of the transmission lines 15-1 to 15-4. Each of the reception antenna elements 14-1 to 14-4 is electrically connected to the terminal section 19-2 by means of the transmission lines 16-1 to 16-4.

It should be noted that the reception antenna element 14-4 corresponds to the first antenna element in the present disclosure. It should be noted that the reception antenna element 14-1 corresponds to the second antenna element in the present disclosure. The transmission line 16-4 that connects the terminal section 19-2 and the reception antenna element 14-4 corresponds to the first transmission line in the present disclosure. The transmission line 16-1 that connects the terminal section 19-2 and the reception antenna element 14-1 corresponds to the second transmission line in the present disclosure.

The transmission antenna elements 13-1 to 13-4 are dipole antennas and perform transmission. The reception antenna elements 14-1 to 14-4 are dipole antennas and perform reception. The radiation direction of the transmission antenna elements 13-1 to 13-4 and the reception antenna elements 14-1 to 14-4 is the upward direction with respect to the paper surface of FIG. 2A.

It should be noted that, in embodiment 1, the transmission antenna elements 13-1 to 13-4, the reception antenna elements 14-1 to 14-4, the transmission lines 15-1 to 15-4, and the transmission lines 16-1 to 16-4 are formed on the substrate 11 using pattern etching or the like.

The ground electrode 17 is formed on the substrate 11. The ground electrode 17 has a plurality of opening areas 18-1 to 18-8, which enclose each of the transmission antenna elements 13-1 to 13-4 and the reception antenna elements 14-1 to 14-4. The opening areas 18-1 to 18-8 are disposed in such a way as not to obstruct radio waves radiated by the antenna elements.

The opening area 18-8 that encloses the reception antenna element 14-4 (first antenna element) corresponds to the first opening area in the present disclosure. The opening area 18-5 that encloses the reception antenna element 14-1 (second antenna element) corresponds to the second opening area in the present disclosure.

To be specific, the ground electrode 17 covers a region that excludes the semiconductor chip 12, the transmission antenna elements 13-1 to 13-4, the reception antenna elements 14-1 to 14-4, and joining sections between the semiconductor chip 12 and the transmission lines 15-1 to 15-4 and 16-1 to 16-4.

The antenna substrate 10 according to embodiment 1 transmits and receives signals of a frequency of a millimeter wave band. In a frequency of a millimeter wave band, wavelengths are in the order of millimeters, and therefore the sizes of the antenna elements are also designed in the order of millimeters. For example, in the case where a frequency of the 140 GHz band is used, the size of the substrate 11 is approximately 10 mm on one side, and the sizes of the antenna elements (transmission antenna elements 13-1 to 13-4 and reception antenna elements 14-1 to 14-4) are approximately 1 to 2 mm on one side.

An antenna substrate on which a plurality of antenna elements are arranged corresponding with the MIMO method is designed taking into account the number of antenna elements and redundancy. There is a small degree of freedom in the arrangement of the transmission antenna elements 13-1 to 13-4 and the reception antenna elements 14-1 to 14-4, and in the arrangement of the transmission lines 15-1 to 15-4 and the transmission lines 16-1 to 16-4. Therefore, as depicted in FIG. 2A, the transmission lines 15-1 to 15-4 are not equal in length. Similarly, the transmission lines 16-1 to 16-4 are not equal in length.

In the antenna substrate 10 according to embodiment 1, the sizes of the opening areas 18-1 to 18-4 of the transmission antenna elements 13-1 to 13-4 are adjusted in accordance with the lengths of the transmission lines 15-1 to 15-4. Similarly, the sizes of the opening areas 18-5 to 18-8 of the reception antenna elements 14-1 to 14-4 are adjusted in accordance with the lengths of the transmission lines 16-1 to 16-4.

The adjustment of the sizes of the opening areas 18-1 to 18-8 will be described with reference to FIG. 2B. FIG. 2B depicts the reception antenna element 14-4 and the opening area 18-8 of the reception antenna element 14-4 as an example. Furthermore, FIG. 2B depicts the direction along a plane (E-plane) along which the electric field of the electromagnetic waves radiated from the reception antenna element 14-4 vibrates, and the direction along a plane (H-plane) along which the magnetic field vibrates.

An element end T1 positioned in the direction along the E-plane of the reception antenna element 14-4 is separated from the ground electrode 17 by a distance L1. Furthermore, an element end T2 positioned in the direction along the H-plane of the reception antenna element 14-4 is separated from the ground electrode 17 by a distance L2. To be specific, the distance L1 is the shortest distance between the element end T1 and the ground electrode 17, and the distance L2 is the shortest distance between the element end T2 and the ground electrode 17 on the side opposite to the transmission line 16-4 (the side on which the reception antenna element 14-4 is not arranged).

The distance L1 and the distance L2 are set with respect to the ground electrode 17 in a similar manner also in the reception antenna elements 14-1 to 14-3 and the transmission antenna elements 13-1 to 13-4.

It should be noted that the element end T1 positioned in the direction along the E-plane of the reception antenna element 14-4 (first antenna element) corresponds to the first element end in the present disclosure. The element end T2 positioned in the direction along the H-plane of the reception antenna element 14-4 (first antenna element) corresponds to the second element end in the present disclosure. Similarly, an element end positioned in the direction along the E-plane of the reception antenna element 14-1 (second antenna element) corresponds to the third element end, and the element end positioned in the direction along the H-plane of the reception antenna element 14-1 (second antenna element) corresponds to the fourth element end.

That is, the distances L1 and L2 of the reception antenna element 14-4 (first antenna element) correspond to the first distance and the second distance in the present disclosure, respectively. Furthermore, the distances L1 and L2 of the reception antenna element 14-1 (second antenna element) correspond to the third distance and the fourth distance in the present disclosure, respectively.

In the antenna substrate 10, the sizes of the opening areas 18-1 to 18-8 are adjusted by altering the distance L1 and the distance L2 of each antenna element in accordance with the lengths of the transmission lines. As depicted in FIG. 2A, the transmission lines connecting to the transmission antenna elements 13-1 to 13-4 become longer in the order of the transmission lines 15-2, 15-1, 15-4, and 15-3. Therefore, the sizes of the opening areas 18-1 to 18-4 for the transmission antenna elements 13 are adjusted so as to become larger in the order of the opening area 18-2, the opening area 18-1, the opening area 18-4, and the opening area 18-3. Similarly, the sizes of the opening areas 18-5 to 18-8 for the reception antenna elements 14 are adjusted so as to become larger in the order of the opening area 18-6, the opening area 18-5, the opening area 18-7, and the opening area 18-8 in accordance with the lengths of the transmission lines.

In this way, in FIG. 2A, the size of the opening area 18-8 (first opening area) that encloses the reception antenna element 14-4 (first antenna element) is different from the size of the opening area 18-5 (second opening area) that encloses the reception antenna element 14-1 (second antenna element).

Next, the adjustment of the sizes of the opening areas 18-1 to 18-8 (adjustment of the distance L1 and the distance L2) and changes in antenna gain will be described using the reception antenna element 14-4 (opening area 18-8) as an example.

Figure 3A:
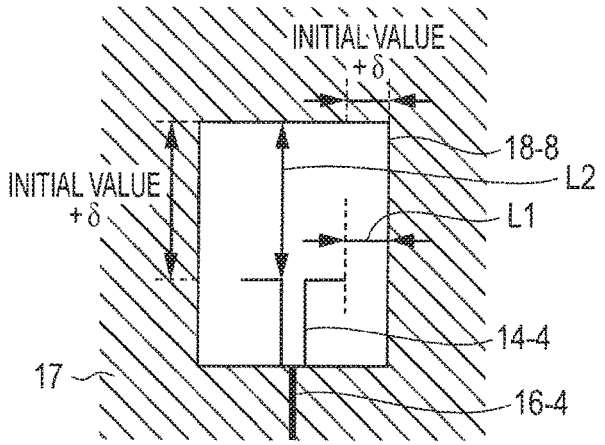
FIG. 3A depicts distances between the antenna element and a ground electrode.

FIG. 3A is a drawing depicting distances between the reception antenna element 14-4 and the ground electrode 17. The antenna gain of the reception antenna element 14-4 in the case where the distance L1 and the distance L2 are each changed from the initial values by an amount of change δ as depicted in FIG. 3A is derived by means of an electromagnetic field simulation.

Figure 3B:
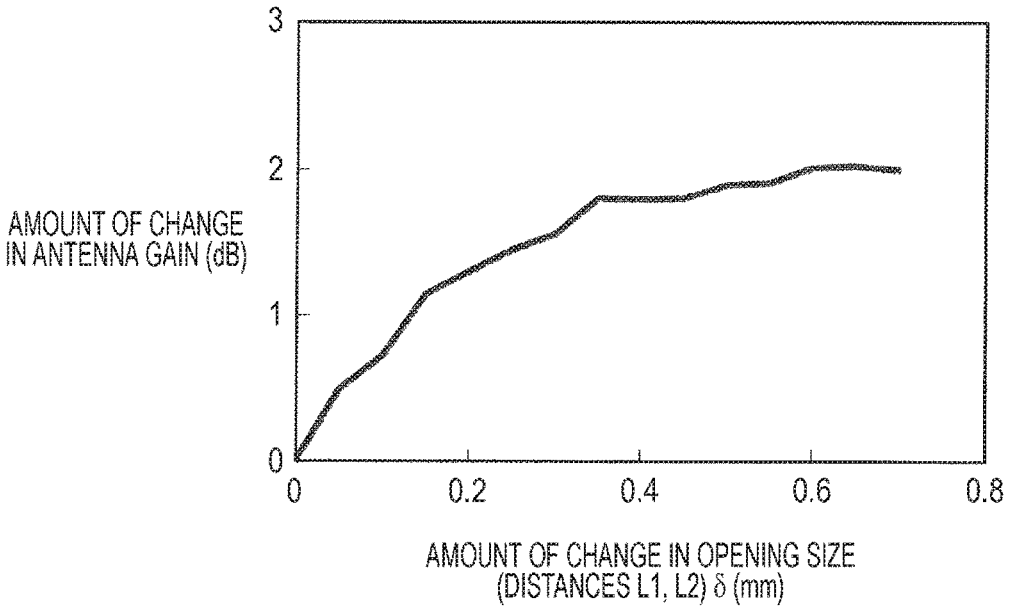
FIG. 3B depicts the results of an electromagnetic field simulation for the antenna element.

FIG. 3B is a drawing depicting the results of the electromagnetic field simulation for the antenna element. FIG. 3B depicts the amount of change in antenna gain in a zenith direction (upward direction perpendicular to the paper surface of FIG. 3A) with respect to the amount of change δ (mm) in the size (distance L1 and distance L2) of the opening area 18-8 in the case where a frequency of the 140 GHz band is used. In FIG. 3B, the horizontal axis indicates the amount of change δ from the initial value of the size (distance L1 and distance L2) of the opening area 18-8, and the vertical axis indicates the amount of change in antenna gain based upon the amount of change δ=0.

As depicted in FIG. 3B, in the case where the amount of change δ is increased, the antenna gain can be improved by approximately 2 dB. It should be noted that, at such time, the matching state of input impedance hardly changes.

In a module configuration in which the semiconductor chip 12 having one side that is approximately 4 mm is mounted on the antenna substrate 10 having one side that is approximately 10 mm, the amount of loss in antenna gain caused by transmission lines when a frequency of the 140 GHz band is used is approximately 2 dB at most. As depicted in FIG. 3B, by increasing the amount of change δ, the antenna gain can be improved by approximately 2 dB. Therefore, the amount of loss in antenna gain caused by the transmission line can be offset by adjusting the size of the opening area 18-8 (distance L1 and/or distance L2).

In FIGS. 3A and 3B, a description has been given using the reception antenna element 14-4 (opening area 18-8) as an example; however, similarly, also in the transmission antenna elements 13-1 to 13-4 and the reception antenna elements 14-1 to 14-3, the amount of loss in antenna gain caused by the transmission lines can be offset by adjusting the sizes (distance L1 and/or distance L2) of the opening areas 18-1 to 18-8.

As described above, in embodiment 1, in the antenna substrate 10 on which the plurality of antenna elements are arranged, even in the case where the lengths of the transmission lines connecting to the antenna elements are different from each other, by adjusting the distances between each of the antenna elements and the ground electrode in the periphery of the antenna elements, it is possible to equalize the antenna gain of the individual antenna elements based upon the terminal sections of the semiconductor chip, and to eliminate differences in antenna gain among the plurality of antenna elements.

Furthermore, in embodiment 1, it is not necessary to change the arrangement of the antenna elements in order to adjust the antenna gain, and therefore there is no impact on controlling the directivity of the antenna elements. Furthermore, in embodiment 1, antenna gain can be adjusted by adjusting the sizes of the opening areas 18-1 to 18-8, namely at least one of the distance L1 and the distance L2, and therefore circuit design is easy and there is no increase in the number of design man-hours.

Furthermore, in the transmission antenna elements 13-1 to 13-4, the transmission antenna element 13-2, which is at least one of the two transmission antenna elements 13-1 and 13-2 having the narrowest interval between each of antenna elements, is arranged in proximity to the semiconductor chip 12. Due to this configuration, the transmission line 15-2 connecting the transmission antenna element 13-2 and the terminal section 19-1 of the semiconductor chip 12 is the shortest. It should be noted that, also in the reception antenna elements 14-1 to 14-4, similarly, a reception antenna element that is at least one of the reception antenna elements having the narrowest antenna element interval, is arranged in proximity to the semiconductor chip 12.

An antenna element that is connected to a comparatively short transmission line has little wiring loss. Therefore, it is not necessary to increase the sizes (distance L1 and/or distance L2) of the opening areas for the antenna elements connected to comparatively short transmission lines, in order to equalize the antenna gain of the antenna elements connected to comparatively short transmission lines and the antenna gain of antenna elements connected to comparatively long transmission lines. Therefore, the antenna elements can be easily brought into proximity with each other.

Figure 4:
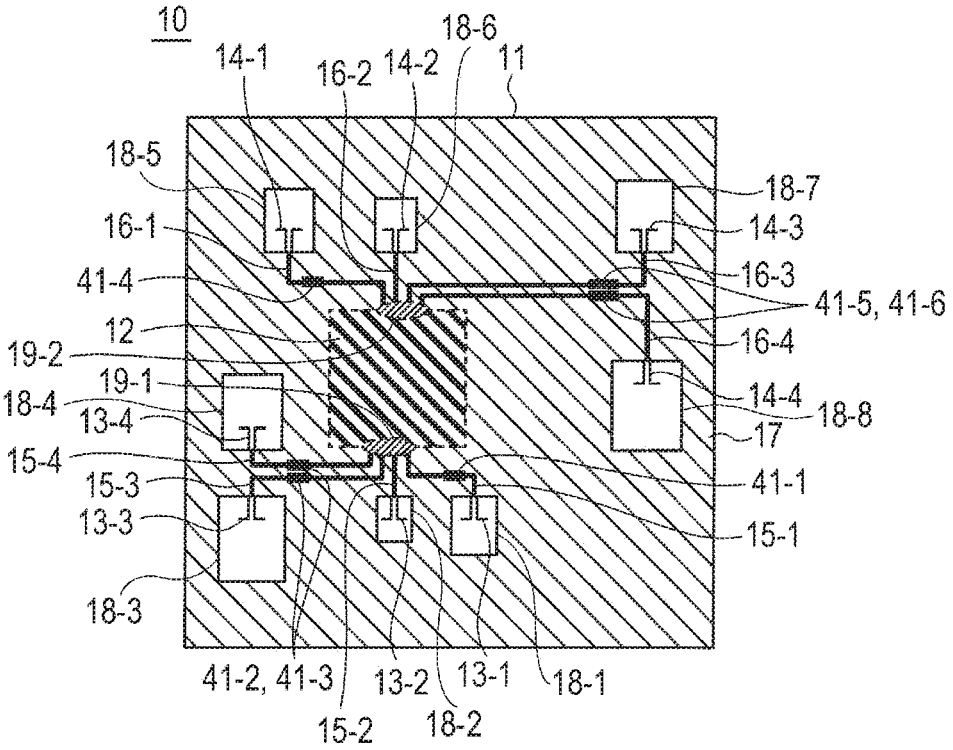
FIG. 4 depicts another configuration of an antenna substrate according to embodiment 1 of the present embodiment.

It should be noted that, in embodiment 1, a transmission line having a slow wave configuration (hereinafter, slow wave transmission line) may be added to some of the transmission lines 15-1 to 15-4 and 16-1 to 16-4. FIG. 4 depicts another configuration of the antenna substrate 10 according to embodiment 1. The configuration depicted in FIG. 4 is a configuration in which slow wave transmission lines 41-1 to 41-6 have been added to some of the transmission lines 15-1, 15-3, 15-4, 16-1, 16-3, and 16-4 in the configuration depicted in FIG. 2A.

The slow wave transmission lines 41-1 to 41-6 can change the phases of passing signals. The details of the slow wave transmission lines 41-1 to 41-6 are described in Japanese Unexamined Patent Application Publication No. 2008-283381, and are therefore omitted in this description.

In the configuration depicted in FIG. 4, by providing the slow wave transmission lines 41-1 to 41-6, deviation in the phases among the antenna elements can be reduced. Consequently, differences in gain among the antenna elements can be adjusted by adjusting the sizes of the opening areas 18-1 to 18-8, and deviation in the phases among the antenna elements can be adjusted by providing the slow wave transmission lines 41. Therefore, in signal processing, calibration processing for signals that are transmitted and received can be omitted or greatly simplified.

In FIG. 4, the slow wave transmission lines 41-1 to 41-6 have been added to some of the transmission lines 15-1, 15-3, 15-4, 16-1, 16-3, and 16-4; however, it should be noted that the locations for providing the slow wave transmission lines 41 are not restricted thereto.

Furthermore, deviation in the phases of signals may be reduced using meandering transmission lines instead of the slow wave transmission lines 41.

Embodiment 2

Figure 5:
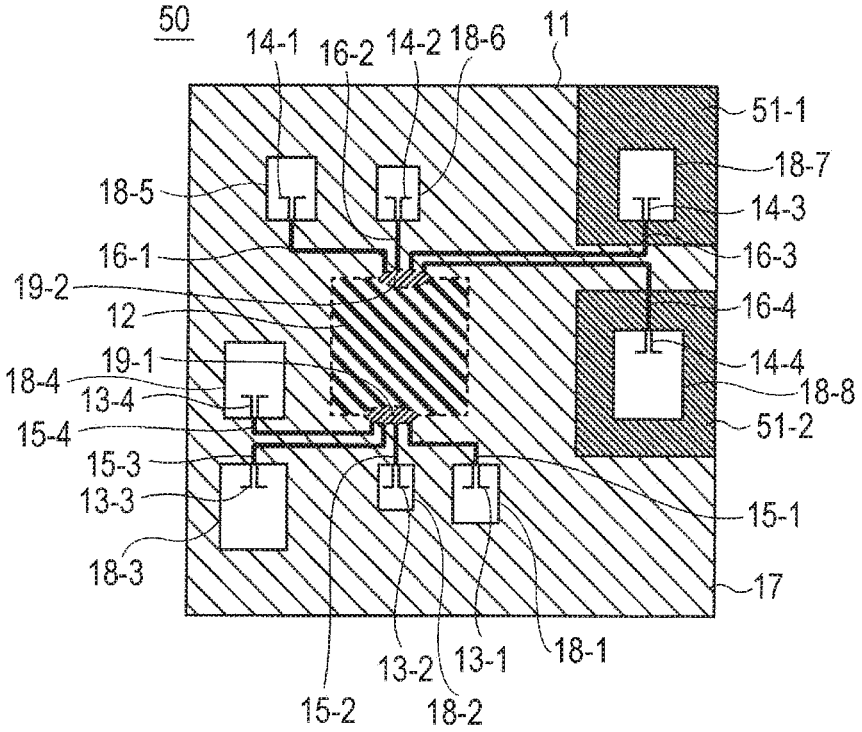
FIG. 5 depicts an antenna substrate according to embodiment 2 of the present disclosure.

FIG. 5 is a drawing depicting an antenna substrate 50 according to embodiment 2. It should be noted that, in FIG. 5, configurations that are the same as in FIG. 2A are denoted by the same reference numbers, and descriptions thereof are omitted.

The antenna substrate 50 according to embodiment 2 is a configuration in which electromagnetic band gap (EBG) structures 51-1 and 51-2 have been added to the antenna substrate 10 depicted in FIG. 2A.

As described in embodiment 1, for antenna elements having a long connecting transmission line and large loss in antenna gain caused by the transmission line, the arrangement interval with other antenna elements is widened. Therefore, there is surplus space in the periphery of antenna elements having a long connecting transmission line. In embodiment 2, by arranging the EBG structures 51-1 and 51-2 in the surplus space in the periphery of antenna elements having a long connecting transmission line (in FIG. 5, reception antenna elements 14-3 and 14-4), the suppression of unnecessary radiation and the isolation among the antenna elements can be improved. It should be noted that the details of the EBG structures are described in Japanese Patent No. 5393675, and are therefore omitted in this description.

According to embodiment 2, by providing EBG structures for antenna elements having large loss in antenna gain caused by the transmission lines, the antenna characteristics are improved, and therefore the antenna gain of the antenna elements can be improved. Thus, the gain adjustment scope (the scope in which gain can be adjusted) of the antenna elements is enlarged, and therefore differences in antenna gain among the antenna elements can be adjusted in greater detail.

In embodiment 2, a description has been given regarding a configuration in which the EBG structures 51-1 and 51-2 are provided in the peripheries of the reception antenna elements 14-3 and 14-4, respectively; however, it should be noted that the locations where the EBG structures 51 are provided are not restricted thereto.

Embodiment 3

Figure 6:
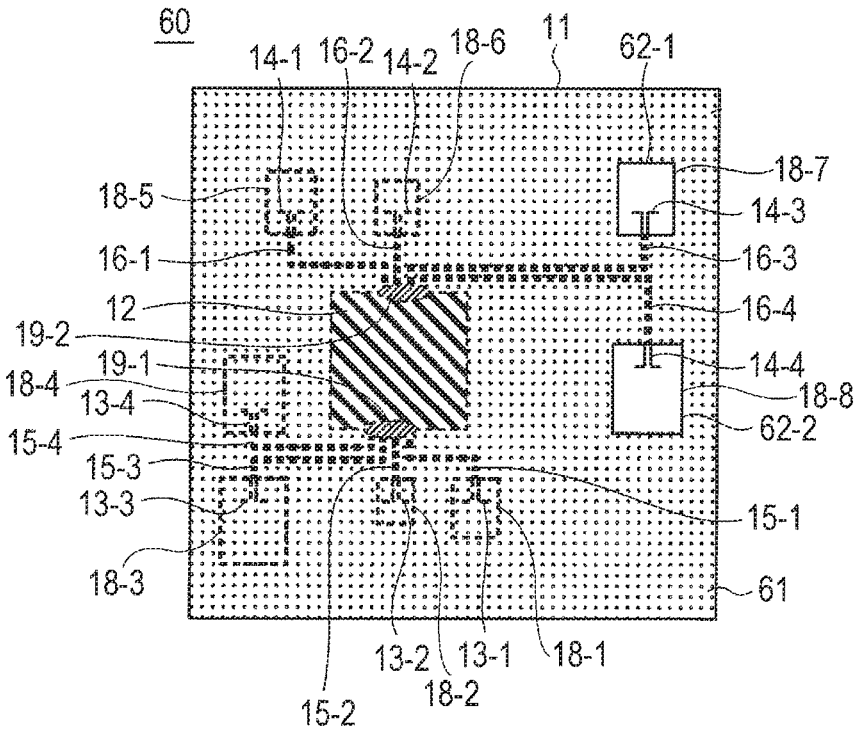
FIG. 6 depicts an antenna substrate according to embodiment 3 of the present disclosure.

FIG. 6 is a drawing depicting an antenna substrate 60 according to embodiment 3. It should be noted that, in FIG. 6, configurations that are the same as in FIG. 2A are denoted by the same reference numbers, and descriptions thereof are omitted.

The antenna substrate 60 according to embodiment 3 is a configuration in which a resist layer 61 is disposed on the outermost surface layer of the antenna substrate 10 depicted in FIG. 2A, and resist layer opening areas 62-1 and 62-2 are provided in portions of the resist layer 61.

The resist layer 61 is disposed in such a way as to cover antenna elements in order to protect the antenna elements. The resist layer opening areas 62-1 and 62-2, which are regions where the resist layer 61 is not present, are provided in locations corresponding to the opening area 18-7 that corresponds to the reception antenna element 14-3 and the opening area 18-8 that corresponds to the reception antenna element 14-4, arranged away from the location where the semiconductor chip 12 is mounted.

In the configuration depicted in FIG. 6, the resist layer 61 is disposed on the antenna elements that are arranged near to the semiconductor chip 12 and have comparatively short connecting transmission lines (in FIG. 6, transmission antenna elements 13-1 to 13-4, reception antenna element 14-1 (second antenna element), and reception antenna element 14-2). The antenna gain of the antenna elements having comparatively short connecting transmission lines is reduced due to the resist layer 61 being disposed. Meanwhile, the antenna gain of the antenna elements having comparatively long connecting transmission lines (in FIG. 6, reception antenna elements 14-3 and 14-4) is not reduced due to the resist layer opening areas 62-1 and 62-2 being provided (due to the resist layer 61 not being disposed).

That is, the antenna gain of antenna elements having comparatively short transmission lines is reduced due to the resist layer 61, and therefore the differences between the antenna gain of antenna elements having comparatively short transmission lines and the antenna gain of antenna elements having comparatively long transmission lines can be reduced.

According to embodiment 3, in addition to the adjustment of the sizes of the opening areas 18 described in embodiment 1, by providing the resist layer 61, the gain adjustment scope (the scope in which gain can be adjusted) of the antenna element is enlarged, and therefore differences in antenna gain among the antenna elements can be adjusted in greater detail.

In embodiment 3, a description has been given regarding a configuration in which the resist layer opening areas 62-1 and 62-2 are provided for the reception antenna elements 14-3 and 14-4; however, it should be noted that the locations where the resist layer opening areas 62 are provided are not restricted thereto.

Embodiment 4

Figure 7A:
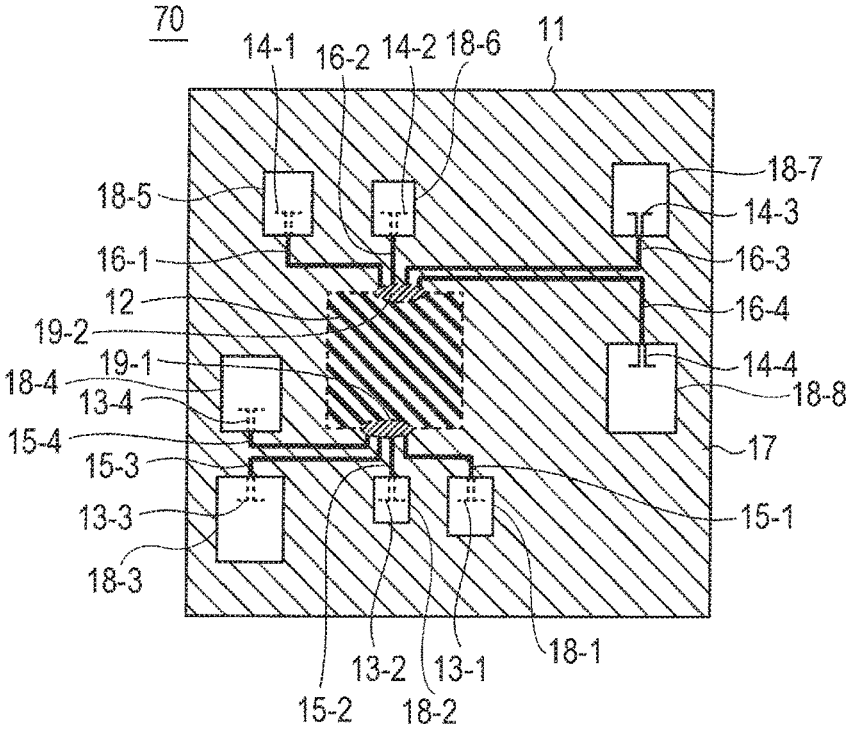
FIG. 7A depicts an antenna substrate according to embodiment 4 of the present disclosure.

FIG. 7A is a drawing depicting an antenna substrate 70 according to embodiment 4. It should be noted that, in FIG. 7A, configurations that are the same as in FIG. 2A are denoted by the same reference numbers, and descriptions thereof are omitted.

The antenna substrate 70 according to embodiment 4 is a configuration in which the transmission antenna elements 13-1 to 13-4 and the reception antenna elements 14-1 and 14-2 of the antenna substrate 10 depicted in FIG. 2A are formed by means of inner layer wiring.

Figure 7B:
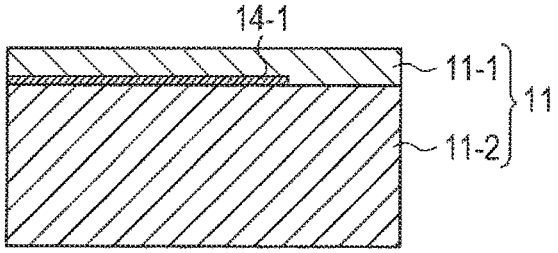
FIG. 7B depicts a cross-sectional schematic view of an antenna element formed by means of inner layer wiring.
Figure 7C:
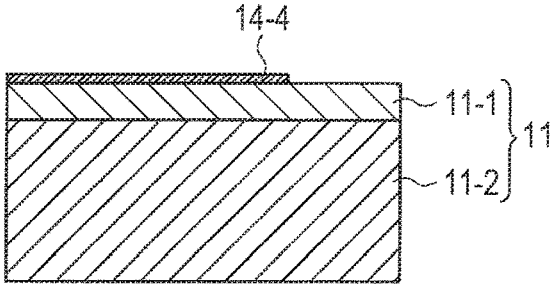
FIG. 7C depicts a cross-sectional schematic view of an antenna element formed by means of surface layer wiring.

Hereinafter, inner layer wiring and surface layer wiring will be described using the reception antenna element 14-1 (second antenna element) and the reception antenna element 14-4 (first antenna element) as examples. FIG. 7B depicts a cross-sectional schematic view of the reception antenna element 14-1 formed by means of inner layer wiring. FIG. 7C depicts a cross-sectional schematic view of the reception antenna element 14-4 formed by means of surface layer wiring.

As depicted in FIGS. 7B and 7C, the substrate 11 includes a first layer 11-1 and a second layer 11-2. The first layer 11-1 and the second layer 11-2 are each dielectric layers. The first layer 11-1 is positioned as a surface layer of the mounting substrate 11, and the second layer 11-2 is positioned on the inner layer side of the first layer 11-1.

As depicted in FIG. 7B, the reception antenna element 14-1 is formed by means of inner layer wiring between the first layer 11-1 and the second layer 11-2, and is positioned on the second layer 11-2. However, as depicted in FIG. 7C, the reception antenna element 14-4 is formed by means of surface layer wiring on the surface of the first layer 11-1, and is arranged on the first layer 11-1.

The reception antenna element 14-1 formed by means of inner layer wiring is covered by the first layer 11-1, and therefore has reduced antenna gain compared to the reception antenna element 14-4 formed by means of surface layer wiring.

That is, in the antenna substrate 70, the antenna gain of the antenna elements having comparatively short connecting transmission lines (in FIG. 7A, transmission antenna elements 13-1 to 13-4 and reception antenna elements 14-1 and 14-2) decreases due to the inner layer wiring. On the other hand, the antenna gain of the antenna elements having comparatively long connecting transmission lines (in FIG. 7A, reception antenna elements 14-3 and 14-4) does not decrease, due to the surface layer wiring. In this way, by selecting whether antenna elements are to be formed by means of surface layer wiring or are to be formed by means of inner layer wiring, in accordance with the lengths of the transmission lines, it is possible to implement adjustments in such a way that differences in antenna gain among the antenna elements decreases.

That is, according to embodiment 4, in addition to the adjustment of the sizes of the opening areas 18 described in embodiment 1, by selecting whether antenna elements are to be formed by means of surface layer wiring or are to be formed by means of inner layer wiring, the gain adjustment scope (the scope in which gain can be adjusted) of the antenna element is enlarged, and therefore differences in antenna gain among the antenna elements can be adjusted in greater detail.

It should be noted that FIGS. 7A to 7C are merely examples, and the present disclosure is not restricted thereto. Preferably, antenna elements arranged near the semiconductor chip 12 are formed by means of inner layer wiring, and antenna elements arranged in positions away from the semiconductor chip 12 are formed by means of surface layer wiring.

In the abovementioned embodiments, descriptions have been given regarding examples in which antenna elements (transmission antenna elements 13-1 to 13-4 and reception antenna elements 14-1 to 14-4) are arranged on a surface on which the semiconductor chip 12 is mounted; however, it should be noted that the present disclosure is not restricted thereto. The antenna elements may be arranged on the surface of the side opposite to the surface on which the semiconductor chip 12 is mounted.

Furthermore, the abovementioned embodiments may be combined as appropriate. For example, an antenna substrate may be configured by combining the slow wave transmission lines described in embodiment 1 and the EBG structures described in embodiment 2.

In the abovementioned embodiments, the transmission lines 5 are depicted as single lines; however, it should be noted that the transmission lines 5 may be sets of two differential lines, for example.

Furthermore, in the abovementioned embodiments, dipole antennas are used for the antenna elements; however, the present disclosure is not restricted thereto. The antenna elements in the present disclosure may be antenna elements that can be installed on a substrate surface. For example, the antenna elements may be patch antennas.

Furthermore, the frequency, substrate size, chip size, and antenna element sizes described in the abovementioned embodiments are examples, and the present disclosure is not restricted thereto.

Furthermore, in the abovementioned embodiments, a description has been given regarding a configuration in which both the transmission antenna elements and the reception antenna elements are arranged on a substrate; however, the present disclosure is not restricted thereto. The transmission antenna elements or the reception antenna elements may be arranged on the substrate.

Furthermore, in the abovementioned embodiments, a description has been given regarding a configuration in which one opening area 18 encloses one antenna element; however, the present disclosure is not restricted thereto. A configuration in which one opening area encloses one or more antenna elements is permissible. In this case also, differences in antenna gain can be adjusted by adjusting the size of the opening area, to be specific, by adjusting the distance L1 and the distance L2.

SUMMARY OF THE PRESENT DISCLOSURE

An antenna substrate according to a first aspect of the present disclosure is provided with: a substrate on which a semiconductor chip having a first terminal and a second terminal are mounted; a ground electrode that is arranged on the substrate and has a first opening area and a second opening area; a first antenna element that is arranged at a first distance away from the ground electrode, on the substrate within the first opening area; a second antenna element that is arranged at a second distance away from the ground electrode, on the substrate within the second opening area; a first transmission line that connects the first terminal and the first antenna element; and a second transmission line that connects the second terminal and the second antenna element, in which the first distance is a shortest distance between the ground electrode and the first antenna element in a direction along a plane along which an electric field among an electromagnetic wave radiated from the first antenna element vibrates, the second distance is a shortest distance between the ground electrode and the second antenna element in a direction along a plane along which an electric field among an electromagnetic wave radiated from the second antenna element vibrates, and the first distance is different from the second distance.

With regard to an antenna substrate according to a second aspect of the present disclosure, in the antenna substrate according to the first aspect of the present disclosure, a first antenna element that further is arranged at a third distance away from the ground electrode, the third distance is a shortest distance between the ground electrode and the first antenna element in a part of the first opening area which the first antenna element and the first transmission line are not connected, in a direction along a plane along which a magnetic field among the electromagnetic wave radiated from the first antenna element vibrates, and a fourth distance is a shortest distance between the ground electrode and the second antenna element in a part of the second opening area which the second antenna element and the second transmission line are not connected, in a direction along a plane along which a magnetic field among the electromagnetic wave radiated from the second antenna element vibrates.

An antenna substrate according to a third aspect of the present disclosure is provided with: a substrate on which a semiconductor chip having a first terminal and a second terminal are mounted; a ground electrode that is arranged on the substrate and has a first opening area and a second opening area, a first antenna element that is arranged at a third distance away from the ground electrode, on the substrate within the first opening area; a second antenna element that is arranged at a fourth distance away from the ground electrode, on the substrate within the second opening area; a first transmission line that connects the first terminal and the first antenna element; and a second transmission line that connects the second terminal and the second antenna element, in which the third distance is a shortest distance between the ground electrode and the first antenna element in a direction along a plane along which a magnetic field of an electromagnetic wave radiated from the first antenna element vibrates, the fourth distance is a shortest distance between the ground electrode and the second antenna element in a direction along a plane along which a magnetic field of an electromagnetic wave radiated from the second antenna element vibrates, and the third distance is different from the fourth distance.

With regard to an antenna substrate according to a fourth aspect of the present disclosure, in the antenna substrate according to the first aspect of the present disclosure, when the first transmission line is longer than the second transmission line, the first distance is longer than the second distance.

With regard to an antenna substrate according to a fifth aspect of the present disclosure, in the antenna substrate according to the third aspect of the present disclosure, when the first transmission line is longer than the second transmission line, the third distance is longer than the fourth distance.

With regard to an antenna substrate according to a sixth aspect of the present disclosure, in the antenna substrate according to the first aspect of the present disclosure, the first antenna element and the second antenna element have identical shapes, and the first opening area and the second opening area have different sizes.

With regard to an antenna substrate according to a seventh aspect of the present disclosure, in the antenna substrate according to the first aspect of the present disclosure, at least a portion of the first transmission line and the second transmission line is a slow wave transmission line.

An antenna substrate according to an eighth aspect of the present disclosure, in the antenna substrate according to the fourth aspect of the present disclosure, is further provided with a resist layer that covers the second antenna element.

With regard to an antenna substrate according to a ninth aspect of the present disclosure, in the antenna substrate according to the fourth aspect of the present disclosure, the substrate is configured from a first layer that is a surface layer of the substrate, and a second layer that is positioned on an inner layer side of the first layer, the first antenna element is arranged on the first layer, and the second antenna element is arranged on the second layer.

With regard to an antenna substrate according to a tenth aspect of the present disclosure, in the antenna substrate according to the first aspect of the present disclosure, the first antenna element and the second antenna element are dipole antennas or patch antennas.

The antenna substrate according to the present disclosure is useful for a transmission/reception module that performs wireless communication in a radar system or communication system of the MIMO method.

What is claimed is:

1. An antenna substrate, comprising:

a substrate on which a semiconductor chip having a first terminal and a second terminal are mounted;

a ground electrode that is arranged on the substrate and has a first opening area and a second opening area;

a first antenna element that is arranged at a first distance away from the ground electrode, on the substrate within the first opening area;

a second antenna element that is arranged at a second distance away from the ground electrode, on the substrate within the second opening area;

a first transmission line that connects the first terminal and the first antenna element; and a second transmission line that connects the second terminal and the second antenna element, wherein the first distance is a shortest distance between the ground electrode and the first antenna element in a direction along a plane along which an electric field among an electromagnetic wave radiated from the first antenna element vibrates, the second distance is a shortest distance between the ground electrode and the second antenna element in a direction along a plane along which an electric field among an electromagnetic wave radiated from the second antenna element vibrates, and the first distance is different from the second distance.

2. The antenna substrate according to claim 1, wherein a first antenna element that further is arranged at a third distance away from the ground electrode, the third distance is a shortest distance between the ground electrode and the first antenna element in a part of the first opening area which the first antenna element and the first transmission line are not connected, in a direction along a plane along which a magnetic field among the electromagnetic wave radiated from the first antenna element vibrates, and a fourth distance is a shortest distance between the ground electrode and the second antenna element in a part of the second opening area which the second antenna element and the second transmission line are not connected, in a direction along a plane along which a magnetic field among the electromagnetic wave radiated from the second antenna element vibrates.

3. An antenna substrate, comprising:

a substrate on which a semiconductor chip having a first terminal and a second terminal are mounted;

a ground electrode that is arranged on the substrate and has a first opening area and a second opening area, a first antenna element that is arranged at a third distance away from the ground electrode, on the substrate within the first opening area;

a second antenna element that is arranged at a fourth distance away from the ground electrode, on the substrate within the second opening area;

a first transmission line that connects the first terminal and the first antenna element; and a second transmission line that connects the second terminal and the second antenna element, wherein the third distance is a shortest distance between the ground electrode and the first antenna element in a direction along a plane along which a magnetic field of an electromagnetic wave radiated from the first antenna element vibrates, the fourth distance is a shortest distance between the ground electrode and the second antenna element in a direction along a plane along which a magnetic field of an electromagnetic wave radiated from the second antenna element vibrates, and the third distance is different from the fourth distance.

4. The antenna substrate according to claim 1, wherein, when the first transmission line is longer than the second transmission line, the first distance is longer than the second distance.

5. The antenna substrate according to claim 3, wherein, when the first transmission line is longer than the second transmission line, the third distance is longer than the fourth distance.

6. The antenna substrate according to claim 1, wherein the first antenna element and the second antenna element have identical shapes, and the first opening area and the second opening area have different sizes.

7. The antenna substrate according to claim 1, wherein at least a portion of the first transmission line and the second transmission line is a slow wave transmission line.

8. The antenna device according to claim 4, further comprising:

a resist layer that covers the second antenna element.

9. The antenna substrate according to claim 4, wherein the substrate is configured from a first layer that is a surface layer of the substrate, and a second layer that is positioned on an inner layer side of the first layer, the first antenna element is arranged on the first layer, and the second antenna element is arranged on the second layer.

10. The antenna device according to claim 1, wherein the first antenna element and the second antenna element are dipole antennas or patch antennas.

* * * * *